United States Patent [19]

Goutard et al.

[11] 4,403,461

[45] Sep. 13, 1983

[54] DEVICE FOR SEALING HARD GELATIN CAPSULES AND FOR PACKING A LIQUID PRODUCT DOSE IN THE THUS SEALED CAPSULE

[75] Inventors: René-Michel Goutard, Verrieres-le-Buisson; Pierre Piry, Briis sous Forges, both of France

[73] Assignees: Automatisme et Technique, Arcueil; Laboratoires Sophartex, Vernouillet, both of France

[21] Appl. No.: 235,994

[22] Filed: Feb. 19, 1981

[30] Foreign Application Priority Data

Feb. 29, 1980 [FR] France ..... 80 04617
Apr. 18, 1980 [FR] France ..... 80 08787

[51] Int. Cl.[3] ..... B65B 1/04; B65B 51/02; B67B 7/00

[52] U.S. Cl. ..... 53/282; 53/383

[58] Field of Search ..... 53/468, 266 R, 282, 53/381 A, 383

[56] References Cited

U.S. PATENT DOCUMENTS

| | | | |
|---|---|---|---|
| 3,078,629 | 2/1963 | Besemer | 53/383 X |
| 3,527,015 | 9/1970 | Aronson | 53/282 X |
| 4,077,182 | 3/1978 | Papaluca | 53/381 A X |

*Primary Examiner*—John Sipos
*Attorney, Agent, or Firm*—Oblon, Fisher, Spivak, McClelland & Maier

[57] ABSTRACT

According to this process, after separating the cap and the body of the capsule, a bead of viscous adhesive is deposited inside this cap and at a certain distance from the edge thereof, and there is introduced into the body of the capsule the dose of product to be packed, then the body thus filled is fitted into the cap thus prepared. In a preferred embodiment of the process, before fitting the body of the capsule into the cap thereof and during this fitting together, the atmosphere bathing the inside and the outside of the capsule is given a predetermined composition.

4 Claims, 13 Drawing Figures

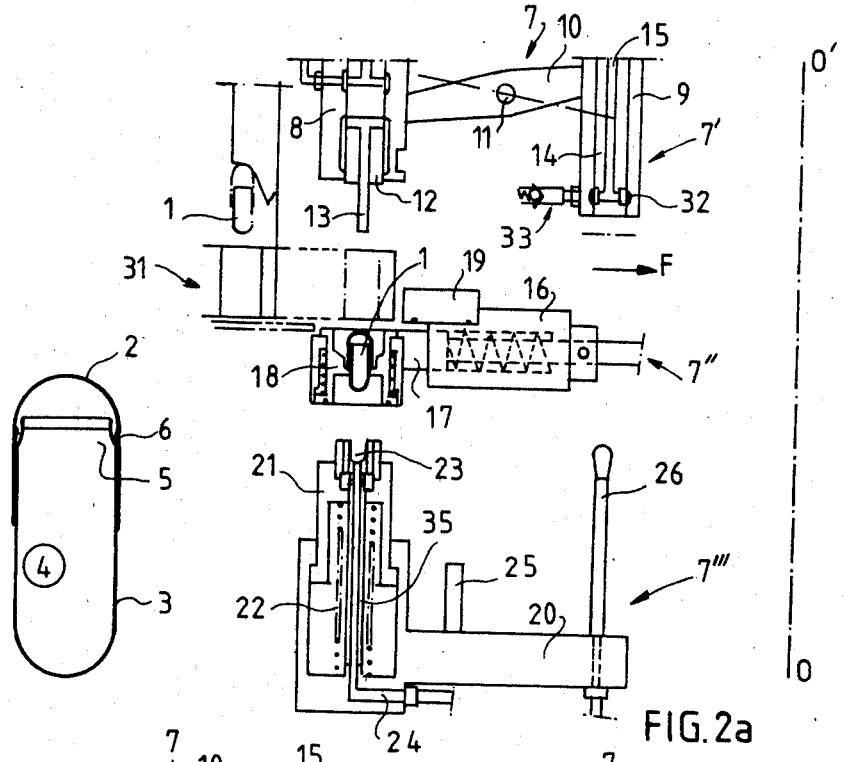
FIG. 1
FIG. 2a
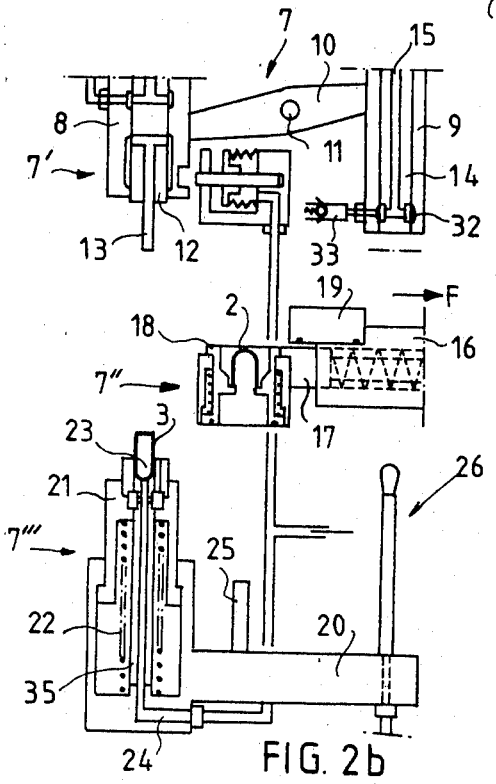
FIG. 2b
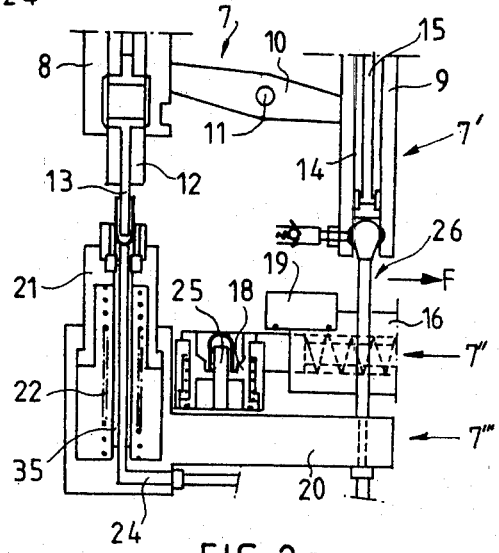
FIG. 2c

DEVICE FOR SEALING HARD GELATIN CAPSULES AND FOR PACKING A LIQUID PRODUCT DOSE IN THE THUS SEALED CAPSULE

BACKGROUND OF THE INVENTION

The invention relates to a process and device for sealing hard gelatin capsules and for packaging a dose of a liquid product in the thus sealed capsule, the sealing and packaging operations being able to be carried out automatically at high speed, with a production for one device of several capsules per second.

The use of envelopes generally made of gelatin, called capsules, is more and more widespread, particularly for packaging solid or liquid medicines. There can be distinguished at present capsules made from hard gelatin and more currently called by the simple term "gelules", and soft gelatin capsules designated more currently under the term "capsules", the first being used for packaging solid medicines, in granular or powder form, whereas the second are more particularly reserved for packing liquid medicines.

Hard gelatin capsules are formed from two distinct parts, namely the "cap" and the "body" fitting one into the other so as to form the complete capsule. The cap and the body are manufactured by the same process consisting in immersing in a gelatin solution the end of a mandrel whose form corresponds to the inner volume of the cap or of the body, then in withdrawing the mandrel from the solution and in letting the layer of gelatin thus deposited dry, which is then removed like a glove finger. In practice a large number of mandrels are used simultaneously transported by a conveyor which ensures successively the immersion of the end of the mandrels, then their passage through a drier, which enables very high production rates per unit of time to be attained.

Soft gelatin capsules are manufactured by a quite different process, which consists in passing between two cylinders having parallel axes and being provided with pockets, two strips of soft gelatin between which is located the product to be packed, which is in principle in liquid form. In the vicinity of the plane containing the axes of the cylinders, the two gelatin strips are highly compressed between the surfaces, at that time very close to one another, of the two cylinders, so that the liquid product to be packed is pushed back between the two gelatin strips to the position of the pockets provided in the cylinders and that, on the other hand, the two gelatin strips are welded together around the periphery of these pockets under the pressure exerted thereon by the cylinders. The sealed capsules thus formed and containing the liquid product are then removed from the gelatin strips. This process also allows very high rates to be obtained but it is much less economic as far as the use of the gelatin is concerned than the dipping process used for manufacturing hard capsules, for the part of the soft gelatin strips situated between the capsules are lost. Apart from this very high outlay for gelatin, another disadvantage of the soft capsule with respect to the hard capsules is that the product must, as we have just seen, be of necessity packed at the same time as manufacture of the envelope of the capsule and on the same installation. This poses difficult problems for, in a general way, the batches of medicines to be packed correspond to a relatively small number of capsules if we compare it with the capacity of production of the installation for manufacturing the capsules. It follows that this installation must be frequently stopped and cleaned to go over from one batch of medicine of a given formula to another batch of another formula. These frequent stops lower considerably the average production rate of the installation, which added to the higher outlay for material further increases the price for packing into soft capsules. On the other hand, in the case of hard capsules where the manufacture of the envelope of the capsule and the packing operations are carried out on separate installations, installations may be provided for packaging whose operating rates are adapted to the size of the series to be treated, so that these installations operate at full capacity and that this, added to the economy achieved for the material, allows the price for packing into hard capsules to be maintained at as low a level as possible.

As furthermore, in numerous cases, it would be preferable to administer the medicine in liquid form rather than in a less directly assimilable solid form, it is clear that the possibility of using hard capsules, not only for packing the medicine in powdery or granular form as is the case at present, but also in liquid form, would present the greatest interest. But the problem is particularly difficult for, since gelatin is a material likely to change from the dimensional point of view, it is necessary to provide during manufacture of the caps and bodies for hard capsules, considerable diametrical clearance so as to allow the cap to be fitted without difficulty onto the body. So that the cap after fitting on, despite this considerable clearance, does not separate from the body during handling to which the capsule will be necessarily subjected, so-called "snap-fit" devices are provided formed for example by an annular depression on the body corresponding with an annular inwardly directed bead on the cap, the interpenetration of the depression and the bead during fitting of the cap on the body holding these two parts of the capsule together. This snap fit which provides a certain locking effect between the cap and the body does not however remedy the lack of sealing of the whole due to the considerable play which it is necessary to provide between these two parts so as to allow fitting together.

Among the numerous attempts which have been made for sealing hard capsules and using them for packing liquid products, the following in particular can be mentioned:

Attempts have been made to form a sealed joint between the cap and the body by coating the outside of the hard capsule after fitting together with an adhesive which, after drying, will form a sealing film. But, apart from the fact that it is difficult to give to this film sufficient thickness for forming a sealed junction between the cap and the body, considering the considerable diametrical play existing at the junction between these two parts, drying of such an adhesive layer is particularly long and presents difficult problems due to the fact that as long as this drying is not completely finished the capsules cannot come into contact with each other.

Another attempt consisted in coating with a viscous adhesive the outer part of the body of the hard capsule which penetrates, on fitting together, into the cap. But the drawback is that, during fitting together, a part of this adhesive is pushed by the cap to the lower part of the body of the capsule, where it forms a bead and where it also presents a drying problem which is extremely difficult to resolve.

Attempts have also been made to incorporate in the liquid medicine intended to be packed in the capsule, additives giving it a thixotropic nature, so that this medicine acquires, after having been thus packed in the capsule, sufficiently high viscosity so as not to flow out through the clearance existing between the cap and the body and may, nevertheless, on arriving in the stomach where it will be subjected to certain mixing, assume again sufficient fluidity. But, besides the fact that the additives thus incorporated in the liquid medicine must be of such a nature and be used in such a quantity that this additive proves in numerous cases to be inadmissible and in others harmful, experience shows that results are not satisfactory. In fact, the thixotropic state of the product is unstable, particularly because of the vibrations to which the capsules are subjected during handling and transport, and after a certain time, leaks appear (all these techniques are described in particular in French Pat. Nos. 2 007 452, 2 385 389, 2 390 946, 2 390 948, 2 390 949 and in U.S. Pat. No. 3,078,629).

SUMMARY OF THE INVENTION

The invention aims at removing these difficulties and creating a process for making hard capsules perfectly tight with respect to liquid products, even when these latter present high fluidity.

It has also proved that the presence of air inside the capsule might have a harmful effect on the products packed in this capsule, particularly when these products are oxydizable.

The invention aims then also at remedying these disadvantages.

The present invention provides an automatic process for sealing hard gelatin capsules and for packing medicines into these capsules, which process is characterized in that, after separating the cap of the capsule from the body of the capsule, there is deposited inside this cap and spaced from the edge of this cap, a strip of a viscous adhesive, whereas the dose of product to be packed is introduced into the body of the capsule, then the body thus filled is fitted into the cap thus prepared.

The process of the invention, as defined above, presents with respect to known solutions, the advantage that the adhesive is deposited inside the cap within a well-defined zone relatively distant from the edge of this cap, so that during fitting together, this adhesive tends to be pushed back inside the capsule and cannot, in any case, ooze out. Thus, the drying problems which stood in the way of the above-mentioned attempts, do not arise here and the capsules may come into contact with each other and be handled immediately after fitting together, whereas the drying may continue for the time required during the period, in general fairly long, which elapses between fitting together and use of the capsule. Furthermore, the adhesive is chosen sufficiently viscous for the sealing to be ensured on fitting together.

According to a particularly advantageous embodiment of the process provided by the invention, previous to fitting the body of the capsule into the cap of the capsule and during this fitting together, the atmosphere bathing the inside and the outside of the capsule is given a predetermined composition, while reducing the pressure of this atmosphere to a level such that after the body of the capsule has been fitted into the cap of the capsule, the gas pressure inside the capsule is at least equal to the ambient atmospheric pressure after sealing of the capsule and its removal from the treatment device.

According to another characteristic of the invention, the atmosphere bathing the inside and the outside of the capsule is given, before fitting together and during fitting together, a composition such that this atmosphere is formed from a gas which exerts no harmful action on the products packed in the capsule.

The invention also relates to a device for implementing the above-defined process, this device being particularly well adapted for carrying out at very high speed the operations required for sealing the capsule and for packing granular, powdery or liquid products into the capsules thus prepared.

This device in accordance with the invention is characterized in that it forms an assembly capable of rotating about a vertical axis and formed from three subassemblies spaced apart from top to bottom, the upper subassembly comprising essentially two slides for vertical movement, articulated to each other by means of a balance bar pivoted about a horizontal axis, a product-distributing piston sliding coaxially inside the slide and extending downwards into a nozzle, whereas an adhesive-distributing piston slides coaxially inside the slide, the intermediate subassembly being essentially formed by a horizontally movable slide integral with an abutment block, whereas a support slides coaxially inside the slide and carries a vehicle, the lower subassembly being essentially formed by a vertically movable support and carrying successively, going from the periphery of the device towards the axis, in the first place a slide able to move upwardly to a stop position under the action of a spring, this slide comprising at its upper end a housing connectable to a vacuum line and intended to receive the body of the capsule, and this slide comprising a coaxial pushrod, in the second place a vertical finger, in the third place a member for taking up and transferring adhesive, this member presenting an essentially vertical orientation, the housing at the upper end of the slide being, by construction, placed straight up from the nozzle, whereas the adhesive pick-up and transfer member is, by construction, placed in vertical alignment with the axis of the slide, and with the axis of the vehicle able to be brought by movement of the slide and of the support respectively into vertical alignment with the housing or into vertical alignment with the finger or else into vertical alignment with the adhesive pick-up and transfer member.

According to an advantageous embodiment of the device of the invention, said device comprises a subassembly formed essentially from a horizontally movable slide integral with an abutment block, whereas a support may slide horizontally with respect to the slide and carries a vehicle for receiving the cap of the capsule, the device also comprising a lower subassembly formed essentially from a support and a slide capable of moving vertically with respect to the support, this slide having, at its upper part, a housing for receiving the body of the capsule, the bottom of which housing is formed by the head of a pushrod pierced with an axial channel, the slide, the pushrod, the vehicle and abutment block being sealably joinable together with interpositioning of sealing joints while thus defining a space containing the two parts of the capsule and connected to the axial channel through a nonaxial channel and an annular space, an annular groove, provided on the periphery of the pushrod, allowing the annular space to be placed in relation with the outside through a chamber and an orifice, after the two parts of the capsule have been fitted together.

DESCRIPTION OF THE DRAWINGS

The invention will be better understood with the help of the complement of description which follows, which refers to embodiments shown by way of nonlimiting example in the accompanying drawings, in which:

FIG. 1 shows in axial section a capsule in which is packed a product, such as a medicine;

Figure 3:
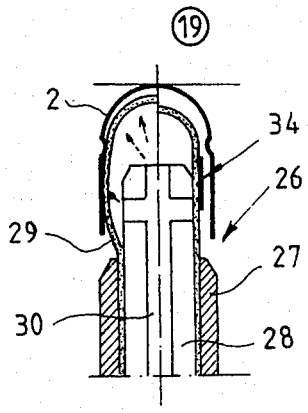
Figure 4:
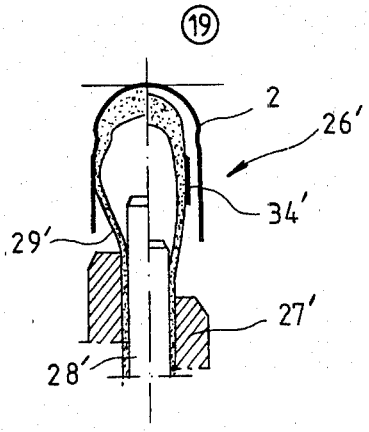

FIGS. *2a* to *2i* show schematically in elevation and in partial section the device of the invention during different phases of operation;

FIG. 3 is a schematical axial section of a first embodiment of the part of the device of the invention for taking up and transferring the adhesive, in the cap of the capsule;

FIG. 4 is a variation of the part of the device shown in FIG. 2; and

Figure 5:
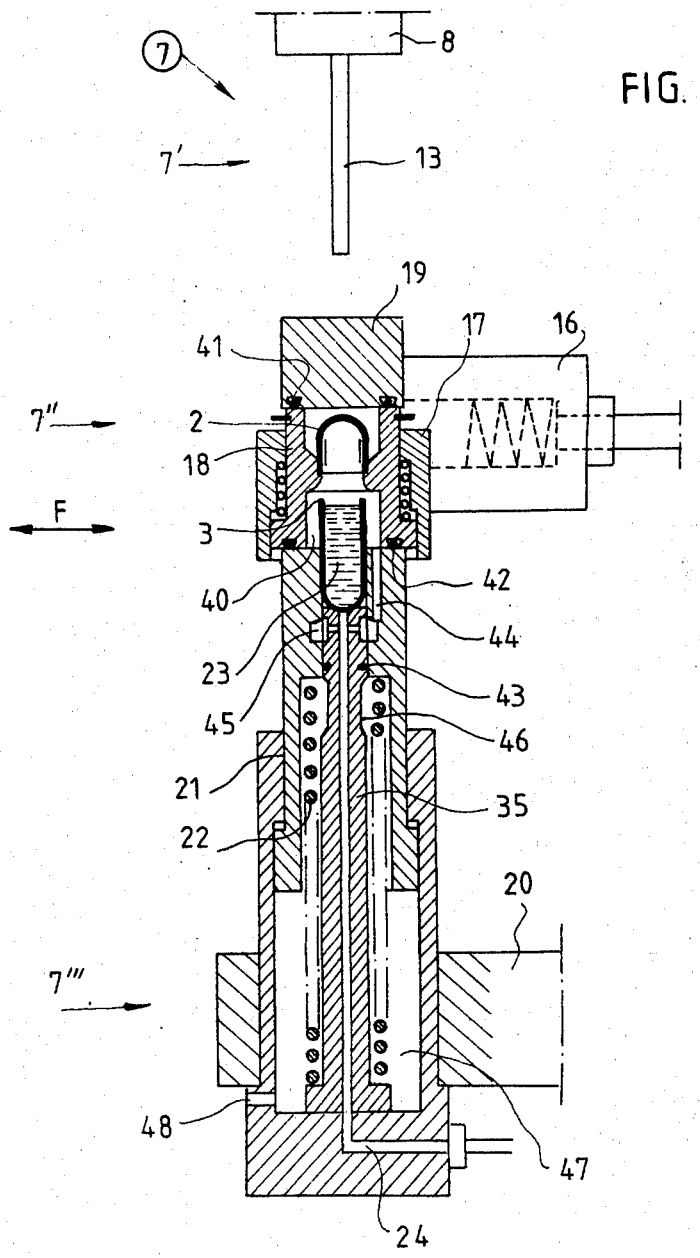

FIG. 5 represents the variation of the device with the possibility of predetermining the composition of the atmosphere.

It will however be readily understood that the drawings and the corresponding descriptive parts are given solely by way of illustration of the object of the invention, of which they form in no wise a limitation.

DESCRIPTION OF THE PREFERRED EMBODIMENTS

A hard gelatin capsule shown generally at 1, comprises a cap 2 and a body 3, fitting into cap 2. Capsule 1 is filled up to a certain distance from the upper edge of body 3 with a product 4, such as a solid or liquid medicine. The assembly formed by an annular outwardly concave curve 5 on body 3 and a corresponding outwardly concave annular curve 6 on cap 2 form the "snap fit" providing cohesion between cap 2 and body 3 despite the relatively great diametrical clearance which must be provided between these two parts, to allow fitting together thereof.

FIGS. *2a* to *2i* show schematically in elevation and in partial section, the device of the invention for carrying out at high speed the operations for sealing and filling the capsule.

The whole, designated by 7, of the device is rotatable about a vertical axis 0–0' shown by a dash-dot line in FIG. *2a* and whose situation with respect to device 7 is recalled in FIGS. *2b* to *2i* by arrow F.

Assembly 7 is composed of three subassemblies, namely, going from top to bottom, the subassemblies 7', 7'' and 7'''. Assembly 7' is formed essentially from two slides 8 and 9 vertically movable and connected together by a balance bar 10 pivoting about a horizontal axis 11. A liquid-distributing piston 12 slides coaxially in slide 8 and extends downwards by a liquid distribution nozzle 13. An adhesive-distributing piston 14 slides coaxially in slide 9 and comprises along its axis, a bore 15 through which is fed the adhesive to be distributed.

Subassembly 7'' comprises essentially a horizontally moving slide 16 inside which slides horizontally a support 17 carrying a vehicle 18. Furthermore, an abutment block 19 is integral with slide 16. Slide 16 and support 17 are offset perpendicularly to the plane of the figure and behind this plane with respect to abutment block 19 and vehicle 18.

Subassembly 7''' comprises essentially a vertically movable support 20 which carries successively from left to right in FIGS. *2a* to *2i*, the following members:

in the first place a vertically moving slide 21, urged upwards in abutment against a shoulder of support 20 by a spring 22 and comprising, at its upper part, a housing 23 connectable to a vacuum line 24, in the second place a vertical finger 25, in the third place an adhesive pick-up and transfer member 26 with an essentially vertical orientation and which will be described in more detail hereafter.

In FIG. 3, member 26 comprises a tube 27 inside which is located a mandrel 28. A membrane 29 is maintained between tube 27 and mandrel 28 and the upper part of this membrane is inflatable by means of compressed air introduced through bores 30 into mandrel 28.

The unit which has just been briefly described operates in the following way:

Referring to FIG. *2a*, slide 16, as well as support 17, are offset to the maximum towards the left, so that vehicle 18 occupies its leftmost position in which it is vertically aligned with nozzle 13 and also with housing 23. Support 20 is in its low position.

By means of a conventional supply system 31, not shown in detail for it does not form part of the invention, and which feeds and orientates empty capsules 1 coming from a hopper, not shown, where they are loosely disposed, an empty capsule is introduced into vehicle 18, so that the edges of the cap of the capsule 1 rest on a shoulder provided in this vehicle 18, whereas the body of capsule 1 projects downwards beyond this shoulder.

From the situation shown in FIG. *2a*, support 20 rises vertically so that slide 21 abuts against the lower face of vehicle 18 and so that housing 23 covers the lower part of the body of the capsule. Through piping 24 housing 23 is evacuated and support 20 is again lowered taking along by suction the body 3 of capsule 1, whereas the cap 2 thereof remains on the shoulder of vehicle 18. Slide 16 then moves rightwards so as to bring vehicle 18 and cap 2 of the capsule in vertical alignment with finger 25, thus arriving at the situation shown in FIG. *2b*. Simultaneously, adhesive is fed into an internal groove 32 of slide 9 through bores 15 of piston 14. This feed is continued until groove 32 is filled then an overflow valve 33 removes the excess adhesive.

From the situation shown in FIG. *2b*, support 20 rises vertically again. Since housing 23 is, by construction, placed in vertical alignment with nozzle 13, this rising movement of support 20 causes the body of capsule 3 to fit on the bottom of nozzle 13. Simultaneously finger 25 penetrates into cap 2 of the capsule. If for any reason the capsule had not been separated, i.e. if its body had not been sucked along by housing 23,the rising movement of finger 25 would have expelled from vehicle 18 the whole of the thus unseparated capsule. The emptiness of vehicle 18, which would have thus been caused, would have been detected by automatic control means, not shown because they are known per se and form no part of the present invention, and these control means would prevent the carrying out of further operations on device 7 considered, such as the feeding of liquid or adhesive.

The rising movement of support 20 also brings the adhesive take-up and transfer member 26 into contact with piston 14 of slide 9, whereas this slide moves downwards bringing its internal groove 32 filled with adhesive opposite membrane 29 provided at the end of member 26. The situation is then that shown in FIG. *2c*.

In this situation, membrane 29 of member 26 is inflated by compressed air arriving through bore 30 as can be seen in the left-hand part of FIG. 3. Thus, the membrane comes into contact with the adhesive deposited in groove 32 then, with bore 15 vented, membrane 29 assumes again its original shape while carrying on its surface a bead of adhesive 34 taken from groove 32. At this moment, support 20 begins a new downward movement, whereas a dose of liquid begins to be fed progressively into body 3 of the capsule through nozzle 13. Determination of this dose of liquid is effected by means of a dosing device, not shown because conventional and not forming part of the present invention. The feeding of the liquid dose ceases when the upper edge of body 3 of the capsule, in its downward movement, arrives a little below nozzle 13. We then find the situation shown in FIG. 2*d*.

From this situation, support 20 continues its downward movement until, successively, the upper end of finger 25 and the upper end of member 26 are situated below the lower face of vehicle 18. Slide 16 as well as support 17, are then offset in their endmost positions towards the right, in which positions the axis of vehicle 18 is located in vertical alignment with member 26, whereas the upper opening of vehicle 18 is covered by the abutment block 19. We then find the situation shown in FIG. 2*e*.

From this situation, support 20 begins a rising movement again, which results in causing the upper end of member 26, i.e. the membrane 29 bearing the bead of adhesive 34, to penetrate into the cap 2 of the capsule held between the shoulder of housing 18 and abutment block 19. We then have the situation shown in FIG. 2*f*. Membrane 29 is then inflated, then immediately deflated again, this resulting in transferring the bead of adhesive 34 to the internal face of cap 2 of the capsule.

Support 20 then moves again downwards so as to bring successively, on the one hand, member 26 and, on the other hand, the upper edge of body 3 of the capsule carried by slide 21, below the lower face of vehicle 18. Slide 16 then moves into its endmost position towards the left, bringing the axis of vehicle 18 and so the axis of cap 2 of the capsule in vertical alignment with the axis of slide 21 and so with the axis of body 3 of the capsule. Thus we have the position shown in FIG. 2*g*.

Figure 2D:
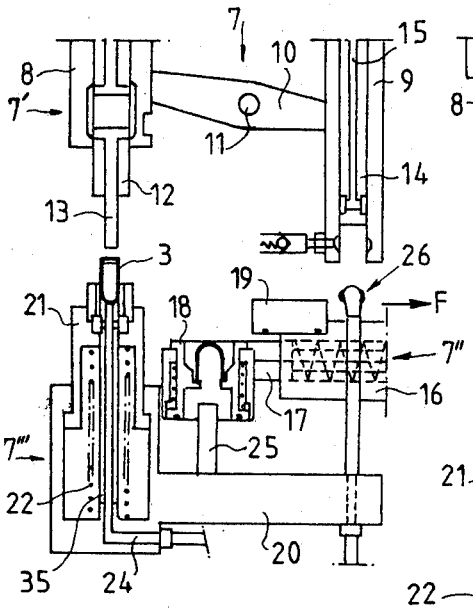
Figure 2E:
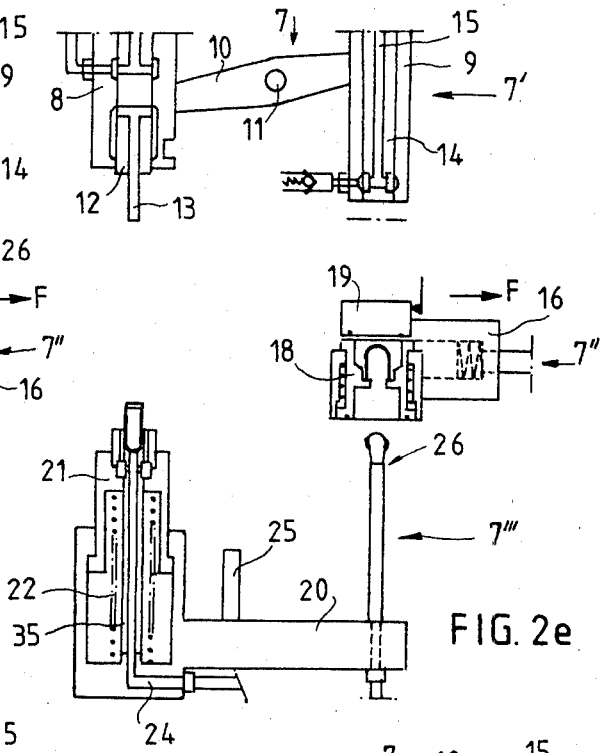
Figure 2F:
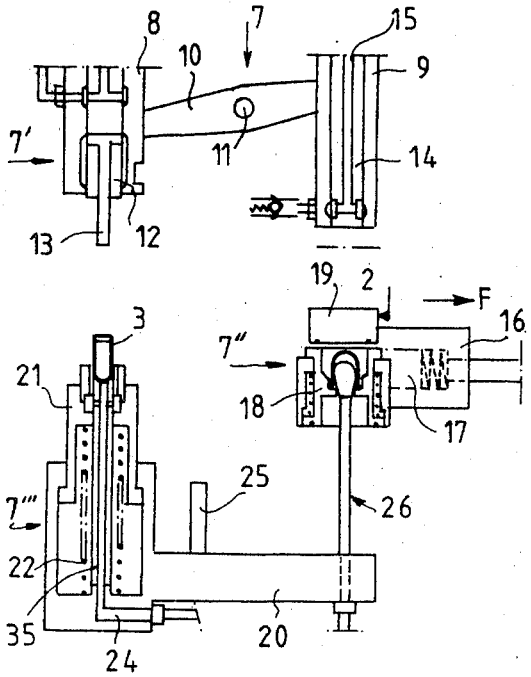
Figure 2G:
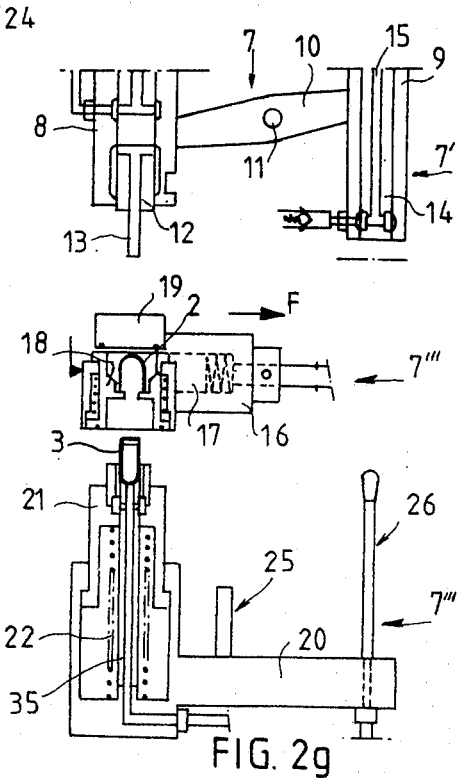
Figure 2H:
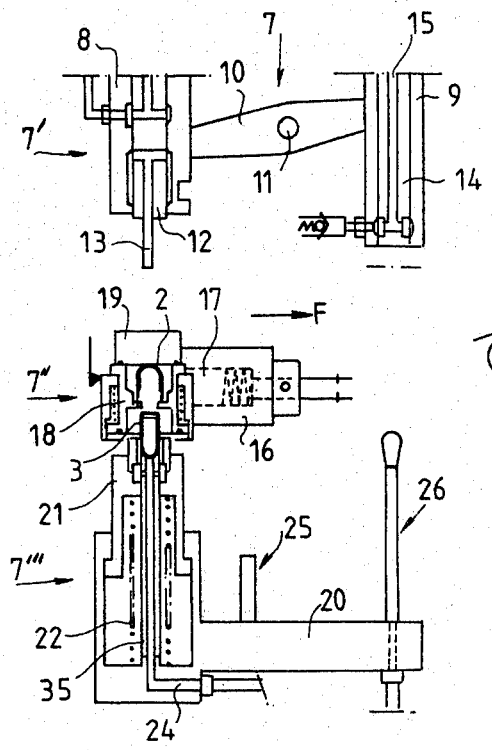
Figure 2I:
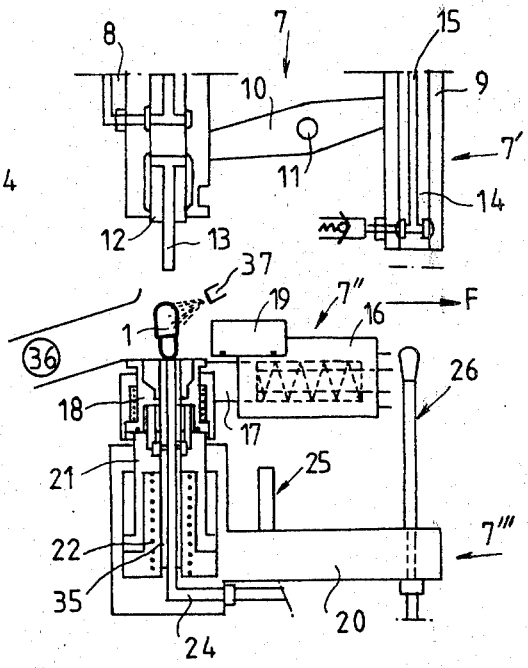

From this position, a new upward movement of support 21 results in the upper face of slide 21 being brought into abutment against the lower face of vehicle 18, as can be seen in FIG. 2*h*. A pushrod 35 moving upwards inside slide 21 then fits body 3 of the capsule into the cap 2 held in place by abutment block 19 and the internal face of which bears the bead of adhesive 34. Thus the two component parts of the capsule are joined sealingly.

Slide 16 then moves rightwards taking with it abutment block 19 and so freeing the upper opening of vehicle 18, whereas pushrod 35 continues its upward movement until its upper end arrives at the level of the upper face of vehicle 18. Capsule 1 has then been completely withdrawn from vehicle 18 and it is ejected laterally into a chute 36 by means of a compressed-air blower 37 (see FIG. 2*i*).

The succession of operations which has just been described and which is illustrated in FIG. 2*a* to 2*i* corresponds to a succession of angular positions of device 7 about the vertical axis 0–0'. Two cases may then be envisaged:

either device 7 rotates with a discontinuous movement about axis 0–0' and the movements of the different parts (support 20, slide 16, etc. . . . ) take place when device 7 stops in a given angular position, or the device is driven with a continuous movement about axis 0–0' and the different movements of parts mentioned above take place while device 7 travels through a given angular zone.

The two solutions are possible, but for very high rates (for example 10 capsules per second or more) the continuous kinematic solution will be preferred which generally allows higher operating rates to be reached and the installation to be operated under better conditions.

FIG. 4 shows a variation 26' of the adhesive pick-up and transfer device 26 shown in FIG. 3. Device 26' differs from device 26 in that the deformation of membrane 29' instead of being obtained by the action of compressed air is obtained by purely mechanical means. In fact, membrane 29' whose lower part is gripped between a tube 27' and a mandrel 28' presents at its upper part a relatively large thickness and so a relatively high rigidly. When the upper part of the membrane abuts against the bottom of cap 2 of the capsule itself abutting against the abutment block 19, this thicker and more rigid part transmits the abutting force to the intermediate part of the membrane which is therefore deformed and which is applied to the internal of face of cap 2. As soon as the pressure exerted by the abutment stops, the membrane assumes again its original shape.

In FIG. 5, the device for sealing capsules and packaging therein a liquid product dose, is designated as a whole by 7. It is subdivided, going from top to bottom, into three subassemblies 7', 7'' and 7'''.

Subassembly 7'' is formed substantially from slide 16 able to move horizontally in the direction of arrow F and firmly fixed to abutment block 19, whereas a support 17 slides, also in the direction of arrow F, with respect to slide 16 and carries a vehicle 18.

Subassembly 7''' comprises essentially a vertically movable support 20 with a slide 21 able to move vertically with respect to this support 20 and urged upwardly into abutment against a shoulder of support 20 by a spring 22. Slide 21 carries at its upper part a housing 23 whose bottom is formed by the head of a pushrod 35 having longitudinally therethrough a channel 24.

In the position shown in the figure, abutment block 19 as well as vehicle 18 have been brought into vertical alignment with slide 21 and this latter has moved upwards, its upper face being applied against the lower face of vehicle 18 and applying the upper face of vehicle 18 against the lower face of abutment block 19. Because of the seals 41, 42 and 43 provided respectively on the lower face of abutment block 19, on the lower face of vehicle 18 and on the periphery of pushrod 35, a space 40 is thus provided sealed with respect to the outside, while however communicating with channel 24 through a channel 44 and an annular space 45.

In the position shown in the figure, cap 2 of the capsule is placed at the upper part of vehicle 18 on a shoulder provided for this purpose in this vehicle, whereas the body 3 of the capsule, containing the product to be packed, is placed in housing 23 of slide 21.

Through channel 24, space 40 is then evacuated, then the air thus extracted from this space 40 is replaced by an atmosphere of a given composition having no harmful action of the products packed in the capsule, the pressure of this atmosphere being maintained at a reduced value.

Pushrod 35 then moves upwards, taking along with it body 3 of the capsule and fitting it into cap 2. At the end of the travel of pushrod 35, and when the fitting is finished, the upper part of an annular groove 46 of pushrod 35 coincides with the annular space 45 of slide 21, thus connecting this annular space 45, through the annular chamber 47 and orifice 48, with the outside. Thus, the outside pressure is exerted on the fitted capsule, this outside pressure being at least equal to the pressure exerted inside the capsule by the atmosphere of a determined composition under a reduced pressure, thus preventing leaks from occurring from inside to the outside of the capsule through the layer of adhesive which has not yet solidified.

If the products contained in the capsule are not adversely affected by the air, it will be sufficient in the above description to create a partial vacuum in space 40 through channel 24, and to carry out the fitting together immediately afterwards.

In the atmosphere of predetermined composition created inside the capsule, a tracer, preferably gaseous, may be introduced for detecting subsequently a sealing defect in the capsule.

After fitting together of the capsule, abutment block 19 retracts laterally, then pushrod 35, continuing its upward movement, ejects the capsule from vehicle 18.

In the preceding description, only the filling of the body of the capsule with a liquid product has been envisaged. Of course, the invention also applies in the case where there is introduced into the body of the capsule a dose of a granular or powdery product, although in this case, sealing of the capsule is not as necessary.

Insofar as the characteristics of the adhesive to be used are concerned, it was pointed out above that it would be advantageous to use a high-viscosity adhesive, for better filling up the necessarily large clearance existing at the outset between the cap and the body of the capsule. Insofar as the nature of the adhesive used is concerned, experience has shown that good results were preferably obtained with solutions of gelatin or polyvinylpyrrolidon in water or in a mixture of alcohol and water.

What is claimed is:

1. A device for sealing hard gelatin capsules comprising a capsule body fitted within a cap and packing in the capsules thus prepared products such as medicines, in granular, powder or liquid form, characterized in that it comprises a unit capable of rotating about a vertical axis and formed from three subassemblies spaced apart from top to bottom, the upper subassembly comprising essentially two vertical-movement slides (8 and 9), articulated together by means of a balance rod pivoting about a horizontal axis, a product-distributing piston sliding coaxially inside one of said slides (8) and extending downwards into a nozzle, whereas an adhesive-distributing piston slides coaxially inside the other of said slides (9), the intermediate subassembly being formed essentially by a horizontally movable slide (16) integral with an abutment block, whereas a support (17) slides coaxially inside said slide (16) and carries a vehicle for carrying the capsule, the lower subassembly being essentially formed by a vertically movable support (20) supporting successively from the periphery of the device towards said vertical axis, in the first place a slide (21) able to move abuttingly upwards under the action of a spring, said lower subassembly slide (21) comprising at its upper end a housing able to be connected to a vacuum line for removing the capsule body from said capsule carried in said vehicle and leaving said cap in said vehicle, and said slide (21) comprising a coaxial pushrod, in the second place a vertical finger for sensing the presence of said cap within said vehicle, in the third place an adhesive pick-up and transfer member, this member presenting an essentially vertical orientation, the housing at the upper end of said slide (21) being, by construction, placed in vertical alignment with said nozzle, whereas the adhesive take-up and transfer member is, by construction, placed in vertical alignment with the axis of said other of said slides (9), and during a single filling and sealing cycle said vehicle is brought by the movement of said horizontally moving slide (16) and support (17) respectively into vertical alignment with said housing, into vertical alignment with said finger and into vertical alignment with the adhesive pick-up and transfer member to thereby apply adhesive from said transfer member to said cap and reinsert said body into said cap.

2. The device as claimed in claim 1, wherein said intermediate subassembly formed essentially from said horizontally movable slide is (16) integral with an abutment block, whereas said support (17) may slide horizontallly with respect to said slide (16) and carries said vehicle for receiving the cap of said capsule, said lower subassembly slide is (21) movable vertically with respect to said support (20), the bottom of said capsule receiving housing being formed by the head of a pushrod pierced with an axial channel, said slide (21), said pushrod, said vehicle and said abutment block being capable of being joined sealingly together with interposition of sealing joints while thus defining said space containing the two parts of said capsule and connected to said axial channel by a nonaxial channel and an annular space, an annular groove provided in the periphery of said pushrod allowing said annular space to be placed in relation with the outside, through a chamber and an orifice, after fitting together of the two parts of the capsule.

3. The device as claimed in claim 1, wherein said adhesive pick-up and transfer member is essentially formed by a stretchable membrane in the form of a glove finger whose lower open part is clamped between a tube and a mandrel inside this tube, whereas its upper closed part may be inflated by means of compressed air arriving through bores in said mandrel.

4. The device as claimed in claim 1, wherein said adhesive pick-up and transfer member is essentially formed by a stretchable membrane in the form of a glove finger, whose lower open end is clamped between a tube and a mandrel inside this tube, the upper closed end of this membrane presenting a greater thickness and consequently a greater rigidity than the intermediate part of the membrane.

* * * * *